United States Patent [19]

Nunes

[11] Patent Number: 4,723,674

[45] Date of Patent: Feb. 9, 1988

[54] LEVELED FOOD PRESERVER STORAGE DEVICE CONTAINER WITH FLOATING LID

[76] Inventor: Morris A. Nunes, 7247 Lee Hwy., Falls Church, Va. 22046

[21] Appl. No.: 924,029

[22] Filed: Oct. 28, 1986

[51] Int. Cl.[4] ..... B65D 39/02

[52] U.S. Cl. ..... 215/231; 220/93; 220/227; 426/124; 426/397; 426/398

[58] Field of Search ..... 215/231; 426/124, 397, 426/398; 220/93, 221, 222, 227

[56] References Cited

U.S. PATENT DOCUMENTS

| | | | |
|---|---|---|---|
| 100,029 | 2/1870 | Hamilton . | |
| 598,676 | 2/1898 | Lochmann . | |
| 620,663 | 3/1899 | McCarty | 215/231 |
| 1,491,325 | 4/1924 | Thomas, Jr. . | |
| 1,669,877 | 5/1928 | Maguire . | |
| 1,753,500 | 4/1930 | Burleigh . | |
| 1,818,924 | 8/1931 | Basmadjian | 215/231 |
| 1,978,025 | 10/1934 | McCown | 220/93 |
| 2,172,457 | 9/1939 | Schwartz . | |
| 2,190,203 | 2/1940 | Barnard . | |
| 2,196,486 | 4/1940 | Anderson . | |
| 2,307,508 | 1/1943 | Jayne . | |
| 2,313,845 | 3/1943 | Sundholm . | |
| 2,453,274 | 11/1948 | Serowy . | |
| 2,605,009 | 7/1952 | Landaal | 215/231 |
| 2,622,760 | 12/1952 | Kissig . | |
| 2,828,886 | 4/1958 | Thomas | 220/93 |
| 3,040,897 | 6/1962 | Holman | 215/231 X |
| 3,804,635 | 4/1974 | Weber . | |
| 3,987,941 | 10/1976 | Blessing | 220/93 X |

FOREIGN PATENT DOCUMENTS

| | | | |
|---|---|---|---|
| 1090533 | 10/1960 | Fed. Rep. of Germany | 220/93 |
| 805.625 | 11/1936 | France . | |
| 109655 | 9/1917 | United Kingdom . | |
| 281228 | 4/1928 | United Kingdom . | |

*Primary Examiner*—Donald F. Norton
*Attorney, Agent, or Firm*—Larson and Taylor

[57] ABSTRACT

A lid for use in combination with a container having smooth inner walls includes a central portion and a flexible annular lip which contacts the inner walls of the container and provides a seal between the lid and the walls. The lip includes a notch therein which allows for the expulsion of air from between the lid and the contents of the container. In the closed position the lid floats in the surface of the container contents. A method for preserving the contents of a container employing this lid.

5 Claims, 3 Drawing Figures

LEVELED FOOD PRESERVER STORAGE DEVICE CONTAINER WITH FLOATING LID

FIELD OF THE INVENTION

The present invention relates to a new and improved device for preserving flowable edible foods, e.g. foods in liquid or powder form when they are stored in a normally unsealed container.

BACKGROUND OF THE INVENTION

In the field of packaging foods, there exist numerous and sophisticated packages for preserving flowable foods in an airtight state which are designed especially for transporting the food product from the manufacturer to the end user. However, these packages are generally useless for preserving the food products in the container after the package has been initially opened by the end user. This presents an economic loss to the end user since edible liquids and powders have a tendency to spoil as a result of exposure to oxygen, contamination from atmospheric impurities, exposure to bacteria or exposure to insects or other pests which infest the material, and/or exposure to light.

Some end user food preserving systems are known, such as reusable containers or resealable original packages. However, such known systems either trap a small quantity of air inside of the package during the sealing process or they improperly seal the food product, the result being that the contents remain subjected to the adverse effects of the above noted contaminants.

For example, U.S. Pat. No. 1,818,924 (Basmadjian) provides a cover for foodstuffs which floats on the surface of the foodstuffs. The cover of Basmadjian does not provide a seal for the container. It merely reduces the amount of air in contact with the surface of the foodstuffs and prevents the infestation of the foodstuff by insects such as flies.

U.S. Pat. No. 339,353 (Wiedemann) also provides a closure for a container which can be lowered into the container to reduce the airspace therein. The Wiedemann closure however, has two slots in it which allow air to circulate down into the food product.

Another example of a closure is shown in U.S. Pat. No. 2,605,009 (Landaal). This patent discloses a food guard which fits over the top of the food in a container to keep the food below the liquid level in the container. This food guard also allows air to circulate down into the container through the slots in the food guard.

Thus there exists a need for a new and improved, more efficient sealing device for sealing flowable foods such as liquids or powders for use by the customer, the end user, after or in the absence of manufacturer's airtight shipment container.

SUMMARY OF THE INVENTION

The purpose of the present invention is to provide a new and improved device for use by an end user for preserving flowable food products.

This purpose is achieved by providing, in combination with a container having smooth interior walls, a generally flat lid which is adapted to conform to the upper surface of the food product within the container, said lid having an edge structure which sealingly mates with the walls of the container.

In a preferred embodiment, the lid, which is capable of floating on the surface of the contents of the container, comprises a semi-rigid generally planar central portion and an upturned flexible annular lip attached to the outer periphery of said central portion and having a notch therein which allows air to pass out from under the lid, said lip being of a size and shape to contact the inner walls of a container to provide a seal between said lip and said container walls.

The present invention also relates to a method for preserving the contents of a container having smooth interior walls. This method comprises the steps of providing a lid in accordance with that of the present invention that snugly fits a container having smooth inner walls, inserting the lid into said container, moving said lid downward into the container to expel the air out of the container through said notch in said lip, and floating said lid on the surface of the contents of the container.

The present invention provides significant advantages over prior art preserving devices. For instance, the lid of the present invention allows the expulsion of air in the container and at the same time prevents entry of new air. The lid floats on the surface of the contents of the container thereby eliminating any air space between the lid and the container contents. In addition, the present invention will scrape the edges of the container clean as it is inserted and removed from the container.

Although the present invention is especially advantageous for sealing liquids stored in containers it also comprises an improved sealing device for highly flowable powder food products stored in containers.

Thus, it is an object of the present invention to provide a new and improved sealing device and method for preserving food products by an end user, especially after the end user has commenced using a portion of the food product.

It is another object of the present invention to provide a new and improved sealing device of the type described which comprises a generally flat lid which floats on the surface of liquid or flowable powder contents of a container and thus seals the contents without the use of engaging systems such as snap-on devices or the like.

It is still another object of the present invention to provide a lid of the type described which seals the food product while concurrently eliminating substantially all of the ambient air from contact with the food product.

It is still another object of the present invention to provide a method, using the sealing device described above, for a customer to preserve flowable food products.

These and other objects of the present invention will become apparent from the detailed description to follow:

BRIEF DESCRIPTION OF THE DRAWINGS

A preferred embodiment of the invention is discussed below with respect to the accompanying drawings wherein.

DETAILED DESCRIPTION OF THE PREFERRED EMBODIMENT

Figure 1:
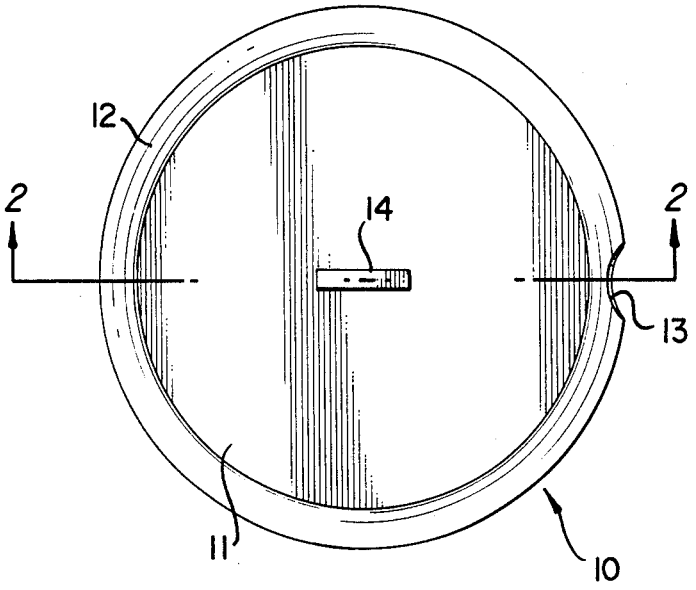
FIG. 1 is a top plan view of a lid of the present invention.

Referring now to the figures, like elements are represented by like numerals throughout the several views.

The illustrated embodiment of the lid 10 of the present invention comprises a central portion 11, a flexible annular lip 12, a notch 13 in the annular lip 12, and a handle 14 attached to the central portion 11. The central portion 11, which is preferably fabricated from a semi-rigid, opaque, material, is generally planar with the outer lip 12 thereof, which comes in close proximity to the walls of a container 15, turned slightly upwards. The generally planar shape of central portion 11 is required so that the lid 10 will conform to the shape of and float on the flat surface of contents 16 within the container 15 while eliminating substantially all air from between the surface of the contents and the lid 10. However, it should be noted that the friction between the lip 12 and the walls of the container 15 will aid the floatation of the lid 10 on the contents 16 of the container 15. Therefore, for the purpose of this invention the lid 10 need only be capable of floating on the surface of the contents 16 of container 15 when it is aided by the friction between the lip 12 and the walls of the container 15. The lid 10 is preferably made from plastic or rubber.

Figure 2:
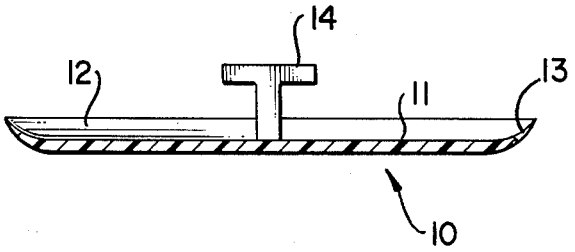
FIG. 2 is a sectional view taken along line 2—2 of FIG. 1.
Figure 3:
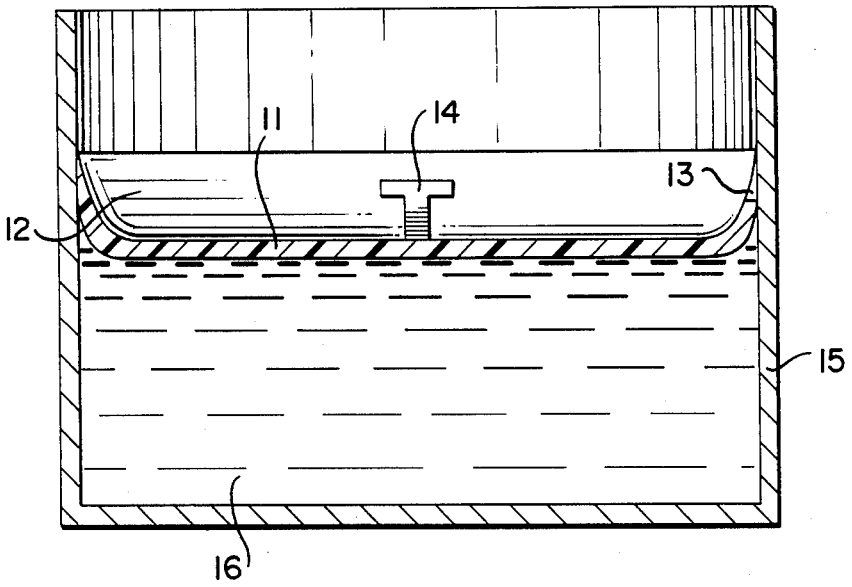
FIG. 3 is a vertical cross-sectional view through a container having a flowable material therein and having the lid of the present invention in place to preserve tne contents of the container.

In its relaxed state the flexible annular lip 12 is slightly upturned at the edges as shown in FIG. 2. This lip 12 is preferably made from a flexible plastic or rubber material and is integral with or permanently attached to the central portion 11. When the lip 12 contacts the inner walls of the container 15, as shown in FIG. 3, the contact between the lip 12 and the container 15 causes the lip 12 to turn up even more than in the relaxed state of FIG. 2, whereby the lip 12 provides a seal between the lid 10 and the container 15. The slight natural upturn of the lip 12, as shown in FIG. 2, facilitates the insertion of the lid 10 into the container 15 and also aids the lid 10 in floating on the surface of the contents 16 of the container 15. The lip 12 skims the inner walls of the container 15 as the lid 10 is moved up and down in the container 15. This skimming action will remove some of the condensation and impurities which may collect on the inner walls of the container 15 above the lid 10 when the lid 10 is in the closed position. This skimming action also serves to force any liquid clinging to the inner walls of the container down into the contents 16 of the container 15 when the lid 10 is inserted into the container 15. The lip 12 also prevents liquid or other contents 16 from overflowing onto the top of the lid 10, which could cause the lid 10 to sink. The notch 13 in the lip 12 is present to allow the escape of air from below the lid 10 as the lid 10 is inserted into the container 15. The notch 13 does not extend far enough into the periphery of the lip 12 to break the seal between the lip 12 and the container 15. However, exertion of pressure on tne lip 12 in the vicinity of the notch 13 by the air beneath the lid 10, as the lid 10 is moved down into the container 15, will cause the lip 12 to separate from the container 15 and thereby allow air to pass through the notch 13 and out into the atmosphere.

The handle 14 may be of any suitable lightweight material and may either be attached to the central portion 11 or formed as an integral part thereof. The lid 10 of the present invention is easy to use, easily cleaned, and reusable. It may be used to seal any food product which may be leveled, including especially liquids and flowable powders, but also other materials which have a surface which either conforms to the lid 10 or may be conformed to the lid 10. Gelatin is an example of such a material.

The lid 10 of the present invention is particularly useful in the temporary storage of food liquids such as wine, salad dressing, milk, and fruit juices and food powders such as flour, grains and spices. However, the present invention is most advantageous for the storage of liquid food materials since the lid 10 more easily floats on a liquid surface. There is no size limitation on the present invention. For instance, it may be applied to a one ounce container of perfume or to a huge storage tank.

In operation one takes a container 15 and inserts material 16 therein. Then, if necessary, the contents 16 are leveled off by agitating the container 15. The leveling of the contents is usually necessary when the lid 10 is being used to preserve a food powder. The lid 10 is then grasped by the handle 14 and tilted slightly to raise the notch 13 to the highest point of the lip 12. Maintaining that attitude, the lid 10 is inserted into the container 15 and moved downward until the lowest point of the lip 12 contacts the contents 16 in the vicinity of the container wall. Then the lid 10 is turned downward, generally pivoted about said lowest point, gradually lowering the portion of the lip 12 having notch 13, and thereby gradually increasing the area of surface contact of the lid 10 with surface of the food product, i.e. said area with surface contact working accross the lid 10 from said lowest point to said notch 13. Finally the position of FIG. 3 is reached, whereby the notch 13 is up against the wall of the container so that it does not interfere with the air seal formed by the lip 12. This movement expels essentially all of the air from below the lid 10 through the notch 13 the last residue of air which passes through notch 13 extending lip 12 and notch 13 away from the container wall. The lid 10 may then be tamped in place on the surface of the contents 16 to expel any air which may still exist between the lid 10 and the contents 16. A second cover may also be placed on top of the container 15 in the standard manner to provide additional protection of the contents 16.

To remove the lid 10 the handle 14 is grasped and pulled upward while gently tilting the lid 10 to raise the notch 13 to the highest point of the lip 12 to avoid the creation of a vacuum.

It will be apparent to one of ordinary skill in the art that many modifications and variations of the present invention are possible within the spirit and scope of the invention.

I claim:

1. In combination:

a container for storing food products and a lid adapted to mate with the inner wall of the container to airtightly seal the food product within the container, the container having a bottom and an inner wall which is perpendicular to the bottom and smooth completely around the inside of the container and for the entire height of the inner wall, the lid being of the same shape as the space defined by said inner wall, taken in a plane perpendicular to said inner wall, said lid having a central portion and a functionally integral flexible lip extending completely around the periphery of the central portion, the central portion being semi-rigid and generally planar, the flexible lip being essentially contiguous with the central portion, at least on the bottom of the lid, said lip, in a relaxed state, extending outwardly and slightly upwardly from said central portion, such that the outside of the lid, in the relaxed state, viewed from above, is larger than the inside of the container by an amount which causes the said lip to turn up from its relazed state when placed horizontally inside of the container with its outermost portion engaging the inside wall of the container to form an airtight seal, said lip having a single notch formed into its outer periphery, the depth of the notch from the outer periphery being within said outermost portion, such that a part of the outermost portion which is located radially inside of the notch contacts the inside wall to complete the essentially airtight seal with the remainder of said outermost portion of the lip, whereby the semi-rigid generally planar central portion, in combination with the lip, essentially conforms to the level surface of the food product and essentially rests thereon to substantially eliminate all air space between the lid and the food product and essentially airtightly seal the food product.

2. An invention as claimed in claim 1, wherein said lid comprises an opaque material.

3. An invention as claimed in claim 1, further comprising a handle attached to said central portion.

4. A method for preserving the flowable food contents of a container having smooth interior walls, comprising the steps of:

providing a lid which comprises a semi-rigid central portion and a flexible outer annular lip having a notch therein, said lid being capable of resting on the surface of the contents of a container, which lid snugly fits a container having smooth inner walls, inserting said lid into said container, moving said lid downward into the container to expel the air out of the container through said notch in said lip by maintaining the notch at the highest point of the lip until the lowest point of the lip contacts the contents of the container, and then gradually contacting more and more of the surface of the flowable food product with said lid, and resting said lid on the surface of the flowable food contents of the container.

5. A method as claimed in claim 4 further comprising the additional step of tamping the lid downward to expel any remaining air from between the lid and the container contents prior to said resting step.

* * * * *